United States Patent [19]

Dehart

[11] Patent Number: 5,069,344

[45] Date of Patent: Dec. 3, 1991

[54] BERRY BASKET AND COVER

[75] Inventor: David L. Dehart, San Jose, Calif.

[73] Assignee: Plexiform, Incorporated, Milpitas, Calif.

[21] Appl. No.: 669,950

[22] Filed: Mar. 15, 1991

Related U.S. Application Data

[62] Division of Ser. No. 532,754, Jun. 4, 1990.

[51] Int. Cl.[5] ..... B65D 21/02

[52] U.S. Cl. ..... 206/508

[58] Field of Search ..... 206/503, 508, 519, 509, 206/545

[56] References Cited

U.S. PATENT DOCUMENTS

| | | | |
|---|---|---|---|
| 4,061,241 | 12/1977 | Reteiny | 206/508 |
| 4,235,338 | 11/1980 | Dugan et al. | 206/508 |
| 4,405,057 | 9/1983 | Stein | 206/508 |
| 4,530,344 | 7/1985 | Zyengan et al. | 206/508 |

*Primary Examiner*—Joseph Man-Fu Moy
*Attorney, Agent, or Firm*—Lorusso & Loud

[57] ABSTRACT

A novel basket cover and the combination of the novel cover and a novel basket are disclosed. The basket cover is essentially a dome-shaped article of clear plastic having a straight skirt depending from a dome portion and corners in the skirt having detents which releasably mate with and lock onto corners of the basket. In a preferred embodiment the detent includes a flat triangular section having an apex aligned with the rim of the dome and extending down to an arc-shaped rigde merging with a convex detent, which in turn, extends to the periphery of the skirt. The basket cover is further provided with ribs extending up its sides and presenting perpendicular basket engaging surfaces which engage and hold in place the bottom of a second basket stacked thereon. In the preferred embodiment the basket cover is further provided with vents which are angled with respect to both the flat top of the cover and its sides. With vents of such a configuration, they will be left partially uncovered when another basket is stacked thereon. The basket itself is provided with bottom vents and side corner vents for receiving cooling air which is believed to pass up through the berries or other produce contained within the basket and exit through the vents in the basket cover.

10 Claims, 4 Drawing Sheets

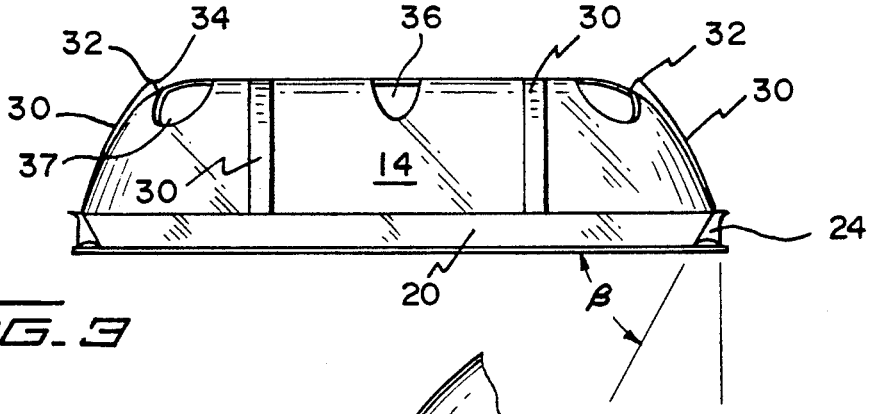
FIG. 3
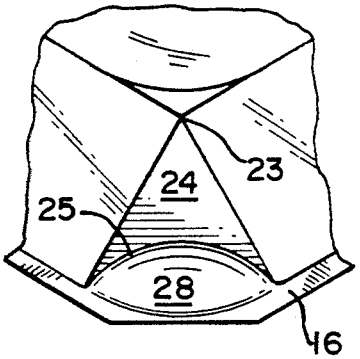
FIG. 4B
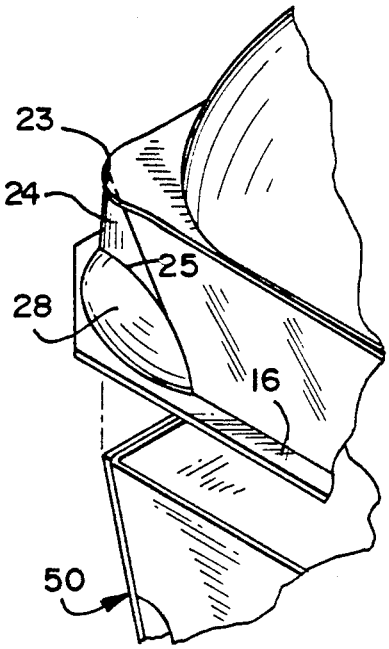
FIG. 4A
FIG. 5
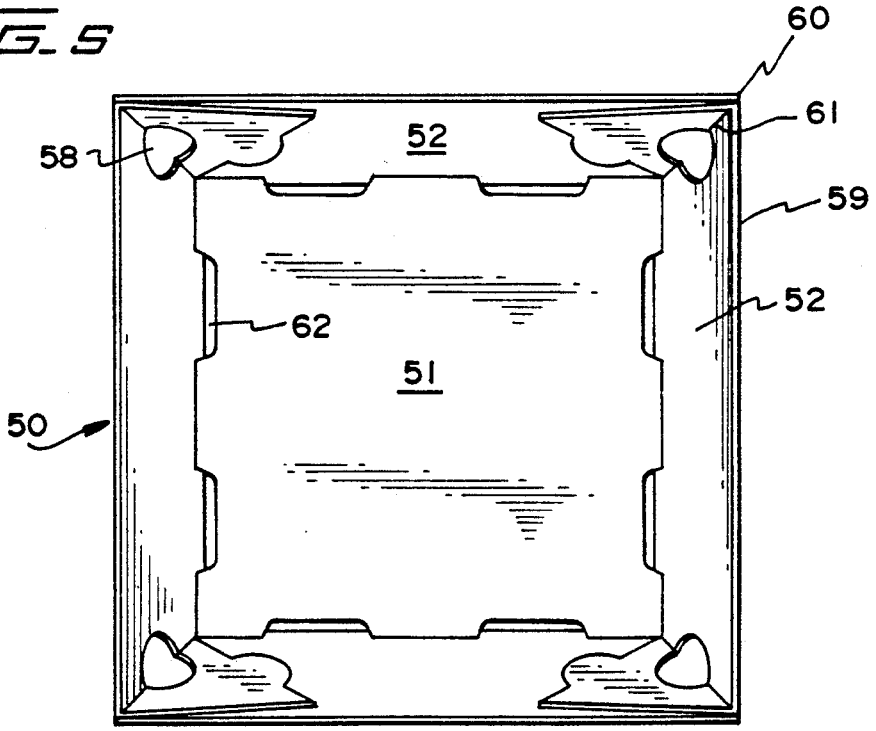

BERRY BASKET AND COVER

This is a division of application Ser. No. 07/532,754, filed June 4, 1990.

BACKGROUND OF THE INVENTION

1. Field of the Invention

This invention relates to a basket for perishable agricultural products and, more specifically, to a berry basket and a cover therefor.

2. The Prior Art

The typical prior art berry basket is formed of a latticework of plastic and is covered with a piece of plastic film secured over the mouth of the basket with a rubber band. However, shelf space represents a considerable investment and cost to the vendor and, accordingly, from the viewpoint of the vendor it would be desirable to stack such baskets, one on top of the other. However, with the conventional design, the baskets cannot be stably stacked and, if stacked, the result is injury to the produce contained therein. Accordingly, there exists a need in the art for a basket having a top permitting a clear view of the produce contained therein an allowing another basket to be stably stacked thereon without damage to the produce contained therein.

As soon after harvesting as is practical, the berries, collected in baskets of the type described above, are placed in a cooling tunnel wherein they are contacted with a stream of cold air to reduce their temperature to about 32° F. to arrest the bacterial action which would otherwise lead to decay and spoilage. After cooling in the cooling tunnel, the produce is typically transported in refrigerated trucks to retail outlets. The energy consumed in the cooling of the freshly harvested produce represents a significant expense to the grower or buyer of the produce and, accordingly, any improvement in the basket design serving to reduce the time required to cool the produce would represent a significant cost savings. Further, stacking within the cooling tunnel without damage to the produce would represent a significant improvement.

SUMMARY OF THE INVENTION

Accordingly, it is an object of the present invention to provide a basket including a cover allowing for stable stacking of the baskets.

Another object of the present invention is to provide a basket having a unique vent configuration serving to reduce the time required to cool the produce after harvesting and prior to shipment.

Yet another object of the present invention is to provide a cover or lid for such a basket which locks into place, thereby diminishing the danger of displacement and damage to the produce contained in the basket, while providing for easy removal and relocking by the end-user (retail customer).

The foregoing objectives are realized by the present invention which provides a unique cover for a produce basket and the combination of the unique cover and a basket body. More specifically, the basket cover includes a four-sided central dome with the four sides of the dome extending from the top of the cover to a dome rim which surrounds the open side of the dome. The cover further includes a peripheral skirt depending from the dome rim and extending to a linear skirt rim at each side of the cover. The four sides of the skirt meet to form the four corners of the cover and are dimensioned to snugly fit over the opening of a produce basket. In at least one corner of the skirt is provided a triangular-shaped indent extending downward from an apex at the dome rim to merge with an arc-shaped convex indent extending upwardly from the skirt rim. At the point where the triangular indent and the arc shaped indent merge they form an arc shaped ridge. The arc-shaped ridge extends toward the basket, inwardly at the apex of the triangular indent and inwardly of the rim of the cover skirt. This structure forms a snap-lock for securing the cover to a basket. In placing the cover on a basket, the last corner of the basket to enter the cover first engages the inner surface of the convex indent and slides upwardly on that surface toward the arc ridge. As further pressure is applied to the top of the cover the corner of the basket will slip over the arc ridge and then pop or snap back outwardly to seat in the apex of the triangular indent.

The basket cover preferably has a flat top and is adapted to receive and hold a basket stacked thereon. In the preferred embodiments of the present invention, the cover has ribs extending up each of its four sides toward the top and terminating at faces extending substantially perpendicular to the cover at the point of termination, these engaging surfaces are arranged so as to engage and hold the bottom of the basket in a manner which prevents the baskets stacked thereon from slipping off of the cover.

The present invention further provides a unique venting configuration which has been found to reduce the time required for the cooling of freshly harvested produce, for example, berries.

Accordingly, the present invention provides a cover in the form of a flat top dome with vents cut into each side of the cover and extending into the flat top of the cover. In other words, the vents are angled with respect to both the sides and the top of the cover.

The present invention further provides the combination of the uniquely vented cover described above and a fiberboard basket having unique venting. More specifically, the basket is formed with four sidewalls which slope from the open top of the basket inwardly to where they merge with the bottom wall of the basket. Further, the side walls have tabs extending below the bottom of the basket and defining air gaps therebetween. The tabs also serve to space the bottom wall of the basket from the surface on which the basket rests, e.g. the flat top of a second basket when a second basket is stacked underneath. Vent holes, preferably one vent hole associated with each of the tabs, are provided in the bottom of the basket. Optionally, further vents, in the form of oval cutouts, may be provided in the sidewalls at the corners where the sidewalls of the basket merge. While the pattern of airflow through the basket during cooling has not been studied, it is believed that the heat emanating from the produce escapes through the vents in the cover along with air entering the basket through the vents in the bottom wall and basket side walls.

BRIEF DESCRIPTION OF THE DRAWINGS

In the drawings:

FIG. 3 is a side view of the cover of the embodiment shown in FIG. 1;

FIG. 4*a* is an exploded view of one corner of the cover shown in FIG. 1, showing in detail the structure providing a snap-lock with a mating corner of the basket;

FIG. 4*b* shows the structure depicted in FIG. 4*a* from underneath;

FIG. 5 is a plan view of the basket of the embodiment shown in FIG. 1;

DESCRIPTION OF THE PREFERRED EMBODIMENTS

The present invention will now be illustrated by the following detailed description of one preferred embodiment thereof.

Figure 1:
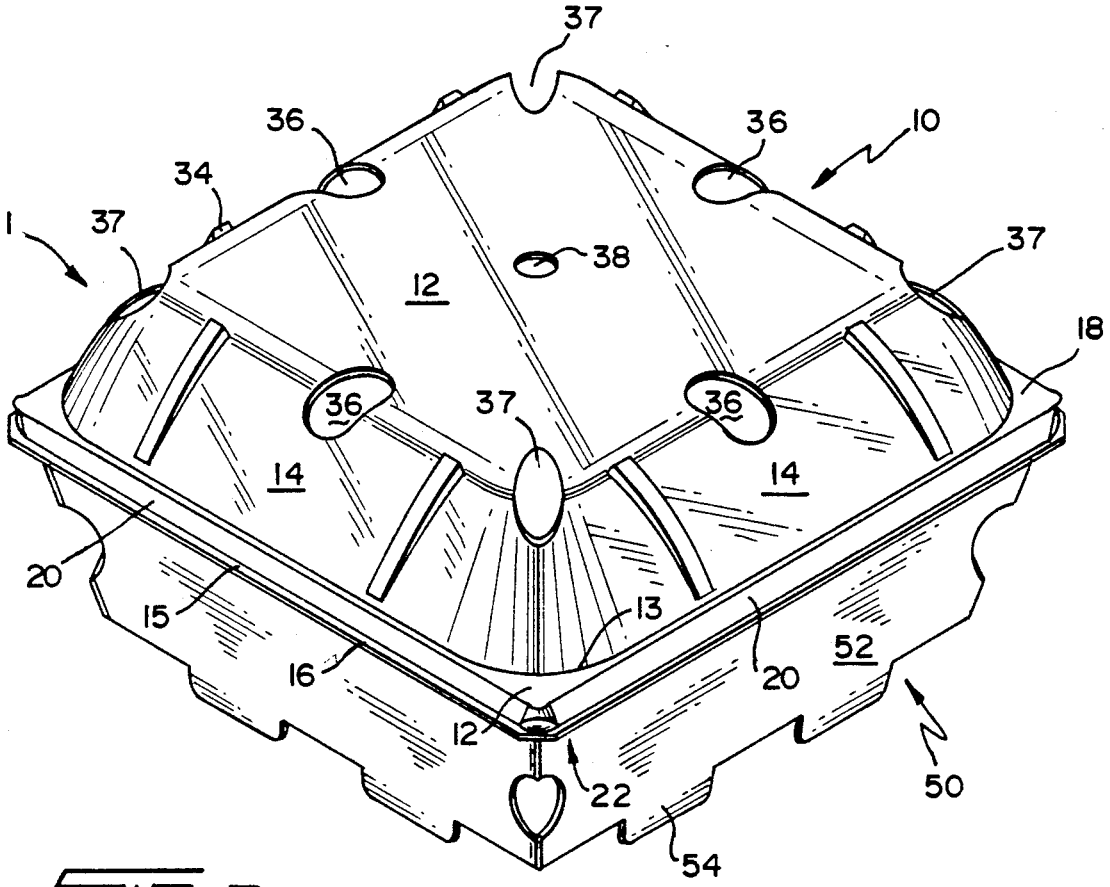
FIG. 1 is a perspective view of one embodiment of the present invention including a basket and a cover in place on the basket.
Figure 2:
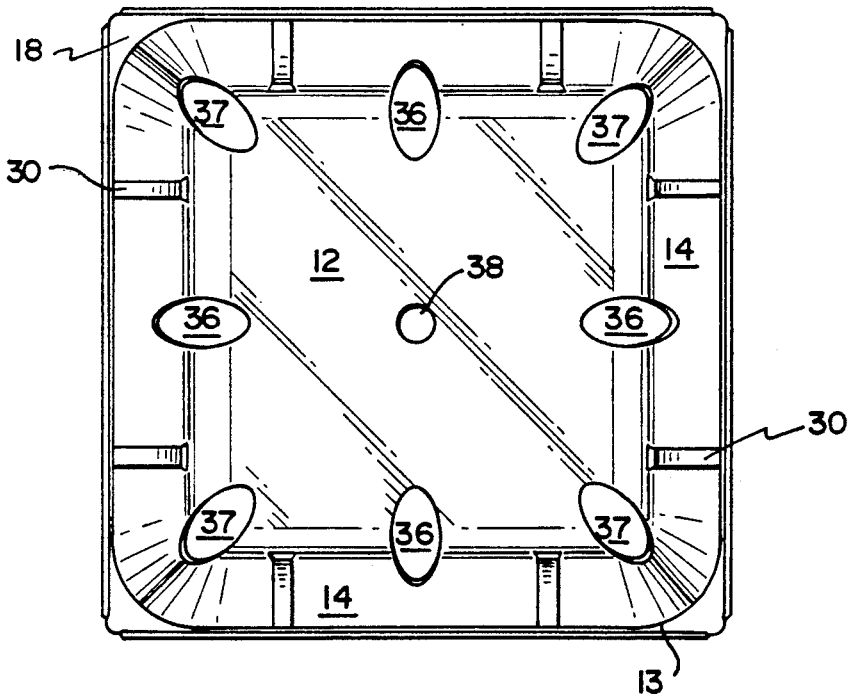
FIG. 2 is a plan view of the cover of the embodiment shown in FIG. 1.

Generally indicated at 1 in FIG. 1 is a berry container including a cover 10 and a basket 50. As shown in FIGS. 1, 2 and 3, the cover 10 is formed with a flat top 12 and four side walls 14 extending downward from the flat top 12 to form a four sided dome. The side walls 14 are formed with a continuous curve extending from the flat top 12 to a dome rim 13 where they merge with straight skirts 20. Straight skirts 20 extend to a skirt rim 15 which represents the lower opening of the cover. The cover is dimensioned to provide a snug fit over the rim of the basket 50. The cover 10 further includes a small horizontal lip 16 extending perpendicularly from the rim 15 of skirt 20. Flat horizontal shoulder portions 18 fill the gap between the dome rim 13 and skirt 20 at each of the four corners of the cover 10.

The snap lock structure 22 by which the cover engages and snaps into a lock position on the basket 50 is shown in detail in FIGS. 4*a* and 4*b*. There it can be seen that the snap lock 22 includes a substantially flat triangular indent 24 which intersects with the skirts 20 at an angle $\alpha$ of approximately 45°. Further, the triangular indent 24 extends upwardly from the opening of the cover at an angle $\beta$ which, as is seen in FIG. 3 is approximately 63°. The triangular indent 24 extends from an apex 23 which is substantially vertically aligned with the dome rim 13 down to an arc-shaped ridge 25 where it merges with a convex detent 28. With this arrangement, the arc-shaped ridge 25 extends toward the basket 50, to a point inward of the apex 23 and inward of the skirt rim 15. As described above, the cover 10 can be initially fitted over three corners 60 of basket 50. To lock the cover 10 in place on the basket 50 one then presses the fourth corner of the cover down onto the basket whereby the fourth corner 60 of the basket will initially be pressed against the inside of the convex indent 28. As further pressure is applied, the corner of the basket 50 will slide along surface 28 toward ridge 25. Yet further pressure will cause the corner 60 to pass over ridge 25 and snap back outwardly thereby nesting in apex 23 of the detent 24. The lid lo can be remove from the basket 50 simply by pressing up with the thumb against the underside of the detent 28. The snapping action by which the cover releasably locks onto the basket 50 is due to the inherent resiliency of the basket 50 and the cover 10.

Figure 7:
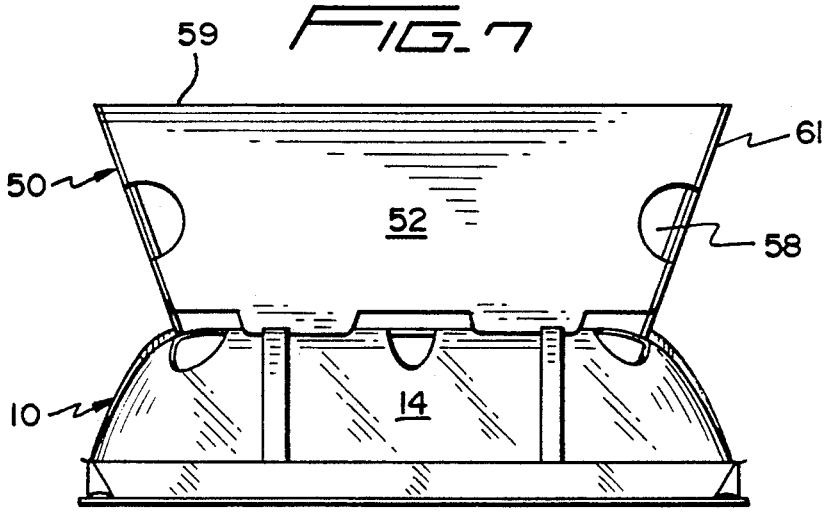
FIG. 7 is a partial side view of a basket as in the embodiment of FIG. 1 stacked on a cover as in the embodiment of FIG. 1.

As can be seen in FIGS. 1, 2 and 3, the cover 10 is further provided with a plurality of stacking ribs 30. These stacking ribs 30 are curved and extend from the dome rim 13 up sidewalls 14 and terminate at points short of the flat surface 12. The apex 32 of each of the stacking ribs 30 lies approximately in the same horizontal plane in which the cover top 12 lies. Each stacking rib 30 presents a basket engaging surface 34 which extends outwardly from the cover 10 at an angle approximately perpendicular to the surface of sidewall 14 at the point where surface 34 joins sidewall 14. As seen in FIG. 7, these engaging surfaces 34 of stacking ribs 30 engage tabs 54 extending below the bottom wall 51 of basket 50. In this manner, a basket 50 may be stably stacked on top of a cover 10.

The cover 10 is further provided with a plurality of oval shaped vents including four centrally located vents 36 and four corner vents 37. Each of the vents 36 and 37 is angled with respect to both the side wall 14 and the flat top 12. In other words, the vents 36 and 37 are cut a substantial distance into both the flat top 12 and the side wall 14. In this manner, when a basket is stacked on cover 10, the lower portions of vents 36 and 37 will remain uncovered. The cover 10 is further provided with a central circular vent 38.

Figure 6:
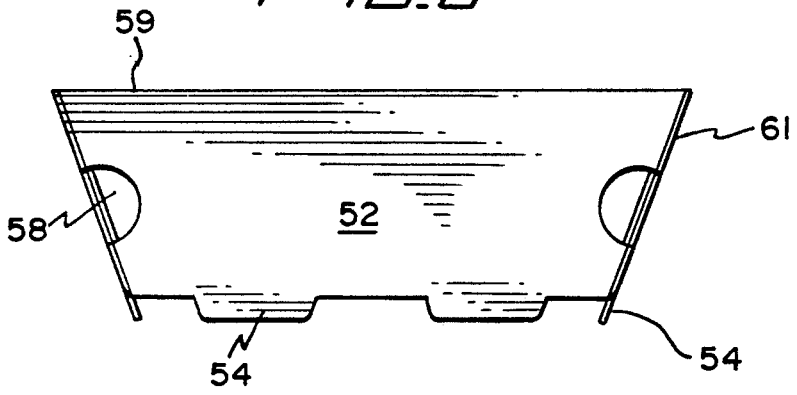
FIG. 6 is a side view of the basket of the embodiment shown in FIG. 1.
Figure 9:
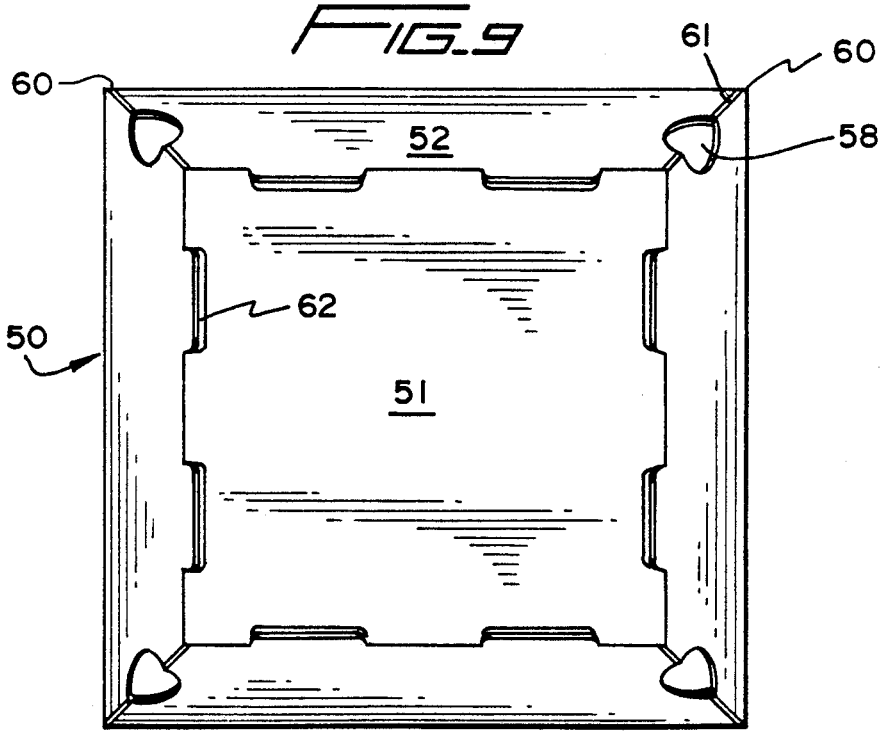
FIG. 9 is a bottom view of the basket of the embodiment of FIG. 1.

As best seen in FIGS. 5 and 6, basket 50 is formed with four side walls 52 which slope upwardly and outwardly from a bottom wall 51 and terminate at basket rim 59. The side walls join at corners 61 each having an apex 60 which mates with the locking structure 22 of the cover 10 described above. As seen in FIGS. 5 and 9, the bottom 51 of the basket 50 is provided with eight cutouts or slots 62 for receiving cooling air which passes upwardly through the basket and vents out of the cutouts in the cover 10. An oval shaped cutout 58 is also provided in each of the corner joints 61. As seen in FIGS. 6 and 7, tabs 54 are provided as extensions of side walls 52. It should be noted that tabs 54 extend below the basket bottom 51 and define air spaces 56 therebetween. These tabs 54 also serve to space the bottom 51 of the basket 50 from the surface on which the basket sits, e.g. the top 12 of a cover 10 on which the basket 50 will sit in a stacked relationship. This structure enables air to pass between each basket and the surface upon which that basket sits so as to enter into the basket through vents 62.

Figure 8:
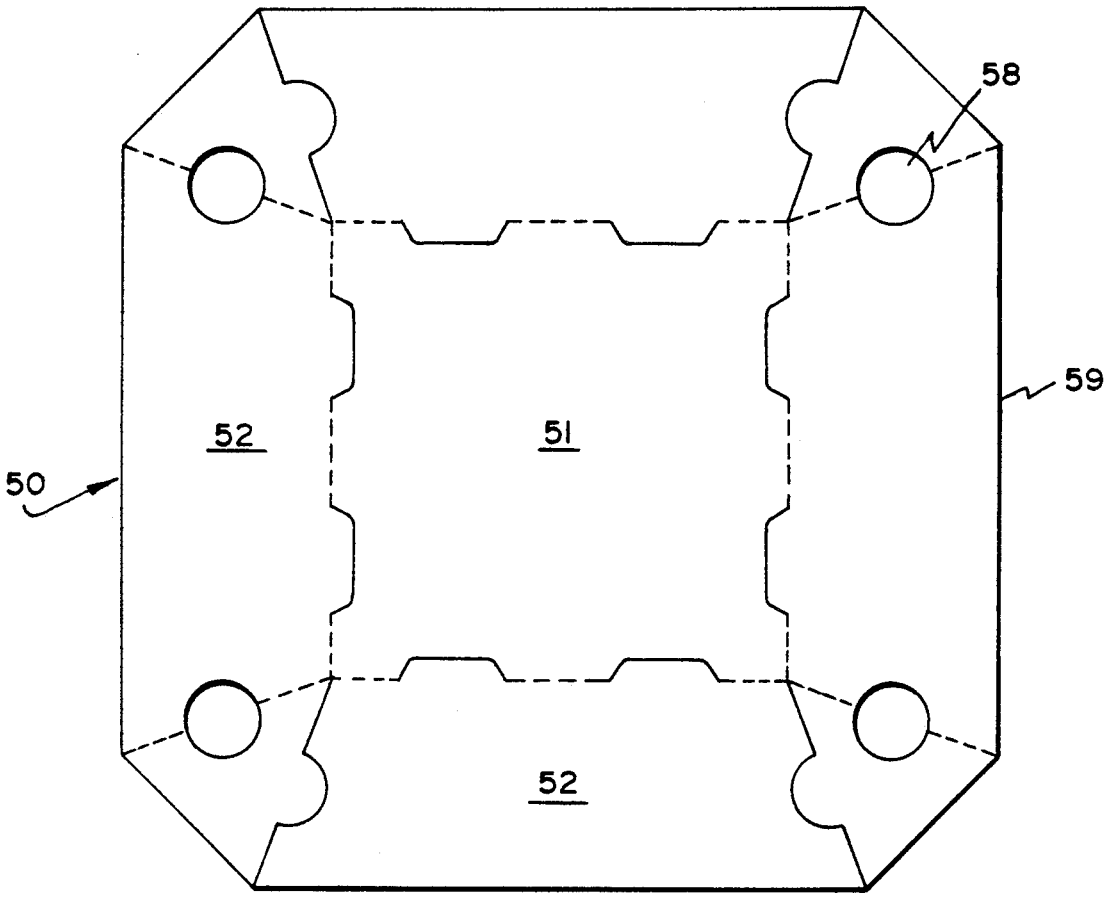
FIG. 8 is a plan view of a blank from which the basket of the embodiment of FIG. 1 is assembled.

FIG. 8 shows the basket in an unfolded state, i.e. as the blank from which the basket is formed.

The cover 10 is preferably fabricated of a clear plastic which enables inspection of the contents of the basket without removal of the cover. The presently preferred material for the cover is a modified polyethylene terephthalate marketed under the tradename PETG. It is believed that other clear plastic materials such as polyvinyl chloride (PVC), oriented polystyrene (OPS) and polyethylene terephthalate (PET) would also be suitable materials for forming the lid 10. PVC, OPS and PET are all considered to be recyclable plastics.

The presently preferred material for fabrication of the basket 50 is a solid fiber chip board made of recycled paper. The advantage of such a fiber board basket over the prior art plastic lattice basket is that the fiberboard basket lends itself to printing. For example, a UPC bar code can be printed on the bottom of the basket to facilitate handling at a grocery checkout counter.

The invention may be embodied in other specific forms without departing from the spirit or essential characteristics thereof. For example, the side walls of the basket cover described above could be straight. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A stackable container including a basket having a bottom and an open top and a cover for the basket, said cover having a top portion and side wall means extending outwardly and down from said top portion to a rim defining an opening in the cover, a plurality of ribs on said cover, each of said ribs extending from a point on said side wall means adjacent said rim to an apex presenting a basket engaging surface, said basket engaging surfaces extending to said apex from points on said cover surface defining a boundary area corresponding to the shape and area of the bottom of the basket, said ribs and basket engaging surfaces being positioned on said cover to receive and hold a basket therebetween for stacking one container on top of another container.

2. The stackable container of claim 1 wherein said ribs extend over at least a major portion of the distance between said rim and said top portion.

3. The stackable container of claim 11 wherein said top portion is flat and the length of each of said ribs is substantially coextensive with the distance between said rim and said flat op, said ribs terminating on said sides.

4. The stackable container of claim 2 wherein said apexes are substantially coplanar with said flat top.

5. The stackable container of claim 4 a straight skirt depending from said cover rim and snugly fitting over the open top of said basket and wherein said cover side wall means and ribs are curved.

6. A cover for a stackable basket having a bottom and an open top, said cover having a top portion and side wall means extending outwardly and down from said top portion to a rim defining an opening in the cover, a plurality of ribs on said cover, each of said ribs extending from a point on said side wall means adjacent said rim to an apex presenting a basket engaging surface, said basket engaging surfaces extending to said apex from points on said cover surface defining a boundary area corresponding to the shape and area of the bottom of the basket, said ribs and engaging surfaces being positioned on said cover to receive and hold a basket therebetween for stacking one basket on top of another basket.

7. The cover of claim 6 wherein said ribs extend over at least a major portion of the distance between said rim and said top portion.

8. The cover of claim 7 wherein the length of each of said ribs is substantially coextensive with the distance between said rim and said top portion, said ribs terminating on said side wall means.

9. The cover of claim 8 wherein said top portion is flat and said apexes are substantially coplanar with said top portion.

10. The cover of claim 9 further having a straight skirt depending from said cover rim and snugly fitting over the open top of the basket and wherein said cover side wall means and ribs are curved.

* * * * *

UNITED STATES PATENT AND TRADEMARK OFFICE

CERTIFICATE OF CORRECTION

PATENT NO. : 5,069,344

DATED : December 3, 1991

INVENTOR(S) : David L. Dehart

It is certified that error appears in the above-identified patent and that said Letters Patent is hereby corrected as shown below:

ON THE FACE OF THE PATENT:

In the abstract, line 8, "rigde" should read --ridge--.

IN THE SPECIFICATION:

Column 1, line 14, "ticework" should read --tice-work--.

Column 3, line 63, "lo" should read --10-- and "remove" should read --removed--.

IN THE CLAIMS:

Column 5, line 28, "11" should read --2--;
line 31, "op" should read --top--; and
line 32, "2" should read --3--.

UNITED STATES PATENT AND TRADEMARK OFFICE

CERTIFICATE OF CORRECTION

PATENT NO. : 5,069,344

DATED : December 3, 1991

INVENTOR(S) : David L. Dehart

It is certified that error appears in the above-identified patent and that said Letters Patent is hereby corrected as shown below:

Column 6, line 1, after "4" insert --wherein said cover further has--.

Signed and Sealed this

Twenty-seventh Day of April, 1993

*Attest:*

MICHAEL K. KIRK

*Attesting Officer*

*Acting Commissioner of Patents and Trademarks*